US006131699A

United States Patent [19]

Leak, Jr.

[11] Patent Number: 6,131,699

[45] Date of Patent: Oct. 17, 2000

[54] LADDER TRAY ATTACHMENT

[76] Inventor: Robert L. Leak, Jr., 50 Lincoln St., Roseville, Calif. 95678

[21] Appl. No.: 09/301,732

[22] Filed: Apr. 29, 1999

[51] Int. Cl.[7] ..... E06C 7/14

[52] U.S. Cl. ..... 182/129; 248/238

[58] Field of Search ..... 182/129, 121, 182/214, 150, 206, 82; 248/210, 238

[56] References Cited

U.S. PATENT DOCUMENTS

| | | | |
|---|---|---|---|
| 988,823 | 4/1911 | Rush | 182/121 |
| 2,518,107 | 8/1950 | Wilson | 182/129 X |
| 2,911,133 | 11/1959 | Ruggieri | 182/129 |
| 3,940,824 | 3/1976 | Gioia et al. | 248/210 X |
| 4,618,030 | 10/1986 | Campbell | 182/121 |
| 4,782,916 | 11/1988 | Hays | 182/150 |
| 4,911,264 | 3/1990 | McCafferty | 182/150 X |
| 4,947,961 | 8/1990 | Dudley | 182/150 X |
| 5,133,429 | 7/1992 | Densley | 182/150 |
| 5,957,238 | 9/1999 | Curvin, II | 182/129 |

*Primary Examiner*—Daniel P. Stodola
*Assistant Examiner*—Hugh B. Thompson

[57] ABSTRACT

A ladder tray attachment for mounting to a head step of a stepladder for resting objects thereon. The ladder tray attachment includes a tray and a mounting frame for mounting the tray to a head step of a stepladder. The mounting frame comprises a spaced apart pair of generally inverted L-shaped mounting members each has elongate top and bottom portions. The bottom portions of the mounting members are coupled to the tray such that the top portions of the mounting members outwardly extend from the tray. The mounting members each also have an elongate hooking portion downwardly depending from the top portion of the respective mounting member. The hooking portions of the mounting members each have spaced apart upper and lower hooks outwardly extending therefrom in a direction towards the bottom portions of the respective mounting member.

11 Claims, 2 Drawing Sheets

LADDER TRAY ATTACHMENT

BACKGROUND OF THE INVENTION

1. Field of the Invention

The present invention relates to tray attachments for ladders and more particularly pertains to a new ladder tray attachment for mounting to a head step of a stepladder for resting objects thereon.

2. Description of the Prior Art

The use of tray attachments for ladders is known in the prior art. More specifically, tray attachments for ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,444,096; U.S. Pat. No. 4,300,740; U.S. Pat. No. 4,460,063; U.S. Pat. No. 4,730,802; and U.S. Pat. No. 5,419,409.

While these devices fulfill their respective, particular objectives and requirements, the aforementioned patents do not disclose a new ladder tray attachment. The inventive device includes a tray and a mounting frame for mounting the tray to a head step of a stepladder. The mounting frame comprises a spaced apart pair of generally inverted L-shaped mounting members each has elongate top and bottom portions. The bottom portions of the mounting members are coupled to the tray such that the top portions of the mounting members outwardly extend from the tray. The mounting members each also have an elongate hooking portion downwardly depending from the top portion of the respective mounting member. The hooking portions of the mounting members each have spaced apart upper and lower hooks outwardly extending therefrom in a direction towards the bottom portions of the respective mounting member.

In these respects, the ladder tray attachment according to the present invention substantially departs from the conventional concepts and designs of the prior art, and in so doing provides an apparatus primarily developed for the purpose of mounting to a head step of a stepladder for resting objects thereon.

SUMMARY OF THE INVENTION

In view of the foregoing disadvantages inherent in the known types of tray attachments for ladders now present in the prior art, the present invention provides a new ladder tray attachment construction wherein the same can be utilized for mounting to a head step of a stepladder for resting objects thereon.

The general purpose of the present invention, which will be described subsequently in greater detail, is to provide a new ladder tray attachment apparatus and method which has many of the advantages of the tray attachments for ladders mentioned heretofore and many novel features that result in a new ladder tray attachment which is not anticipated, rendered obvious, suggested, or even implied by any of the prior art tray attachments for ladders, either alone or in any combination thereof.

To attain this, the present invention generally comprises a tray and a mounting frame for mounting the tray to a head step of a stepladder. The mounting frame comprises a spaced apart pair of generally inverted L-shaped mounting members each has elongate top and bottom portions. The bottom portions of the mounting members are coupled to the tray such that the top portions of the mounting members outwardly extend from the tray. The mounting members each also have an elongate hooking portion downwardly depending from the top portion of the respective mounting member. The hooking portions of the mounting members each have spaced apart upper and lower hooks outwardly extending therefrom in a direction towards the bottom portions of the respective mounting member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new ladder tray attachment apparatus and method which has many of the advantages of the tray attachments for ladders mentioned heretofore and many novel features that result in a new ladder tray attachment which is not anticipated, rendered obvious, suggested, or even implied by any of the prior art tray attachments for ladders, either alone or in any combination thereof.

It is another object of the present invention to provide a new ladder tray attachment which may be easily and efficiently manufactured and marketed.

It is a further object of the present invention to provide a new ladder tray attachment which is of a durable and reliable construction.

An even further object of the present invention is to provide a new ladder tray attachment which is susceptible of a low cost of manufacture with regard to both materials and labor, and which accordingly is then susceptible of low prices of sale to the consuming public, thereby making such ladder tray attachment economically available to the buying public.

Still yet another object of the present invention is to provide a new ladder tray attachment which provides in the apparatuses and methods of the prior art some of the advantages thereof, while simultaneously overcoming some of the disadvantages normally associated therewith.

Still another object of the present invention is to provide a new ladder tray attachment for mounting to a head step of a stepladder for resting objects thereon.

Yet another object of the present invention is to provide a new ladder tray attachment which includes a tray and a mounting frame for mounting the tray to a head step of a stepladder. The mounting frame comprises a spaced apart pair of generally inverted L-shaped mounting members each has elongate top and bottom portions. The bottom portions of the mounting members are coupled to the tray such that the top portions of the mounting members outwardly extend from the tray. The mounting members each also have an elongate hooking portion downwardly depending from the top portion of the respective mounting member. The hooking portions of the mounting members each have spaced apart upper and lower hooks outwardly extending therefrom in a direction towards the bottom portions of the respective mounting member.

Still yet another object of the present invention is to provide a new ladder tray attachment that provides an enlarged, flat area on the head step of a stepladder for stable resting of objects thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
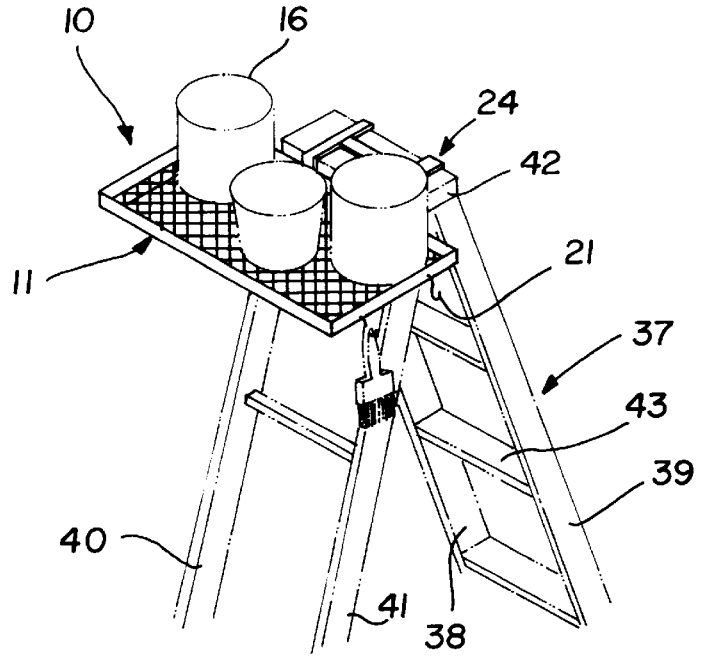
FIG. 1 is a schematic perspective view of a new ladder tray attachment in use according to the present invention.
Figure 2:
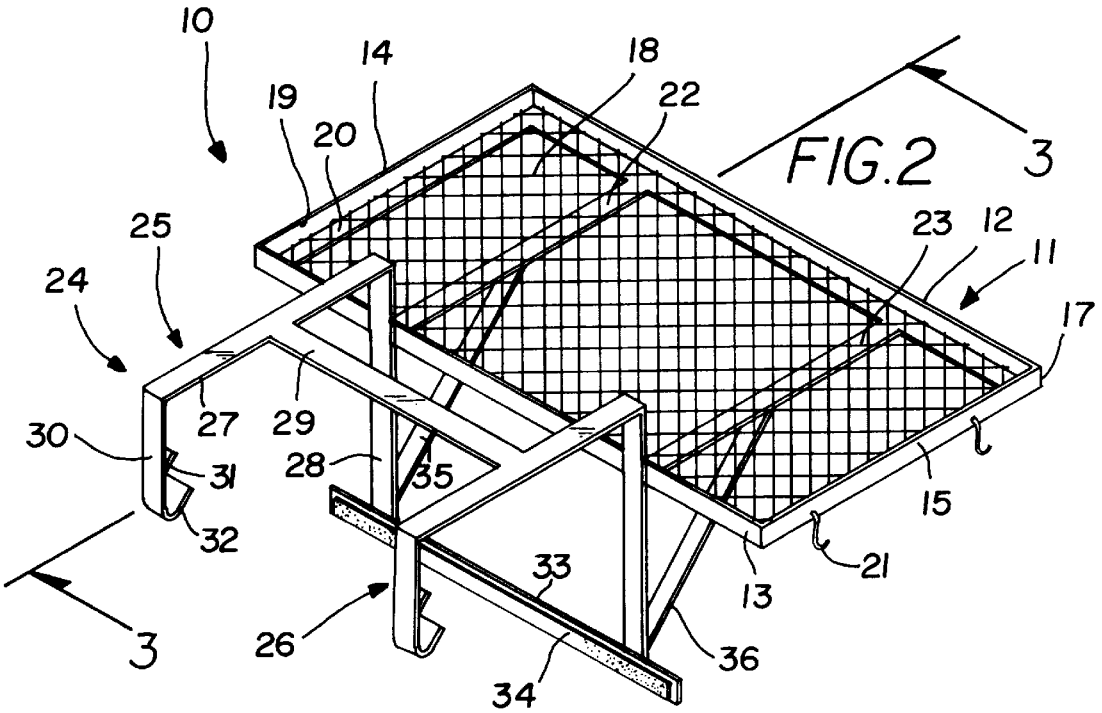
FIG. 2 is a schematic perspective view of the present invention.

With reference now to the drawings, and in particular to FIGS. 1 through 4 thereof, a new ladder tray attachment embodying the principles and concepts of the present invention and generally designated by the reference numeral 10 will be described.

As best illustrated in FIGS. 1 through 4, the ladder tray attachment 10 generally comprises a tray and a mounting frame for mounting the tray to a head step of a stepladder. The mounting frame comprises a spaced apart pair of generally inverted L-shaped mounting members each has elongate top and bottom portions. The bottom portions of the mounting members are coupled to the tray such that the top portions of the mounting members outwardly extend from the tray. The mounting members each also have an elongate hooking portion downwardly depending from the top portion of the respective mounting member. The hooking portions of the mounting members each have spaced apart upper and lower hooks outwardly extending therefrom in a direction towards the bottom portions of the respective mounting member.

In closer detail, the tray attachment 10 includes a generally rectangular tray 11 having generally rectangular upper and lower faces, and an outer perimeter comprises substantially parallel front and back edges 12,13, and a pair of substantially parallel side edges 14,15 extending between the front and back edges of the tray. In use, as illustrated in FIG. 1, the upper face of the tray is designed for resting objects 16 thereon.

The tray preferably comprises a generally rectangular open outer frame 17 extending along the outer perimeter of the tray and a mesh inner screen 18 surrounded by the outer frame of the tray. In one preferred embodiment, the inner mesh screen may comprise expanded metal. The outer frame of the tray has a generally L-shaped transverse cross section defining upper and lower portions 19,20 of the outer frame extending substantially perpendicular to one another. The inner screen of the tray is rested on the lower portion of the outer frame. The inner screen has a generally rectangular outer perimeter which is preferably coupled to the outer frame of the tray. The upper portion of the outer frame defines an upper lip upwardly extending around the outer perimeter of the inner screen for helping keep objects on the upper face of the tray.

Preferably, the tray has at least one utility hook 21 coupled to he outer perimeter of tray. Ideally, the utility hook is positioned at one of the side edges of the tray. In use, the utility hook is designed for hanging objects therefrom.

The tray preferably further includes a spaced apart pair of substantially parallel cross supports 22,23 extending between the front and back edges of the tray. The cross supports are extended substantially parallel to the side edges of the tray and substantially perpendicular to the front and back edges of the tray. The cross supports of the tray are positioned beneath the inner screen of the tray and lie in a common plane with the lower portion of the outer frame of the tray.

The attachment also includes a mounting frame 24 for mounting the tray to a head step of a stepladder. The mounting frame comprises a spaced apart pair of generally inverted L-shaped mounting members 25,26 each having elongate top and bottom portions 27,28. The top portion of each mounting member is extended substantially perpendicular to the bottom portion of the respective mounting member.

The bottom portions of the mounting members are coupled to the upper portion of the outer frame of the tray at the back edge of the tray. One of the mounting members is positioned towards one of the side edges of the tray. The other of the mounting members is positioned towards the other of the side edges of the tray. The bottom portions of the mounting members are extended substantially perpendicular to a plane in which the tray lies. The bottom portions of the mounting members each have an upper region upwardly extending from the plane of the tray and a lower region downwardly extending from the plane of the tray.

The top portions of the mounting members lie in a common plane with one another located above the plane of the tray. An elongate upper cross brace 29 is preferably is extended substantially perpendicularly between the top portions of the mounting members.

The mounting members each also have an elongate hooking portion 30 downwardly depending substantially perpendicularly from the top portion of the respective mounting member and spaced apart from and extending substantially parallel to the bottom portion of the respective mounting member. The hooking portions of the mounting members each have spaced apart upper and lower hooks 32 outwardly extending therefrom in a direction towards the bottom portions of the respective mounting member. The upper hook of each hooking portion is spaced apart from the top portion of the associated mounting member and interposed between the top portion of the associated mounting member and the lower hook portion of the respective hook portion.

Preferably, an elongate back brace 33 is extended between lower regions of the bottom portions of the mounting members and coupled to lower ends of the bottom portions of the mounting member. The back brace preferably has a resiliently deformable strip 34 provided thereon and facing in a direction towards the hooking portions of the mounting member.

The bottom portion of each mounting member is positioned adjacent an associated cross support of the tray. Each bottom portion and the associated cross support lie in a common vertical plane with one another. Each of the mounting members preferably has an elongate strut 35,36 extending between the lower end of the bottom portion of the respective mounting member and the associated cross support of the tray to provide addition support to the tray when supporting a load thereon.

Ideally, all of the components of the attachment are coated with a resiliently deformable rubber coating.

In use, the tray attachment is designed for mounting to a head step of a stepladder. In particular, the stepladder 37 has a pair of side rails 38,39 and a pair of support legs 40,41 pivotally coupled to the head step 42 of the stepladder, the stepladder further has a plurality of steps 43 extending between the side rails of the stepladder. The head step of the stepladder has a downwardly depending perimeter lip 44 therearound. The perimeter lip has a generally rectangular periphery.

Figure 3:
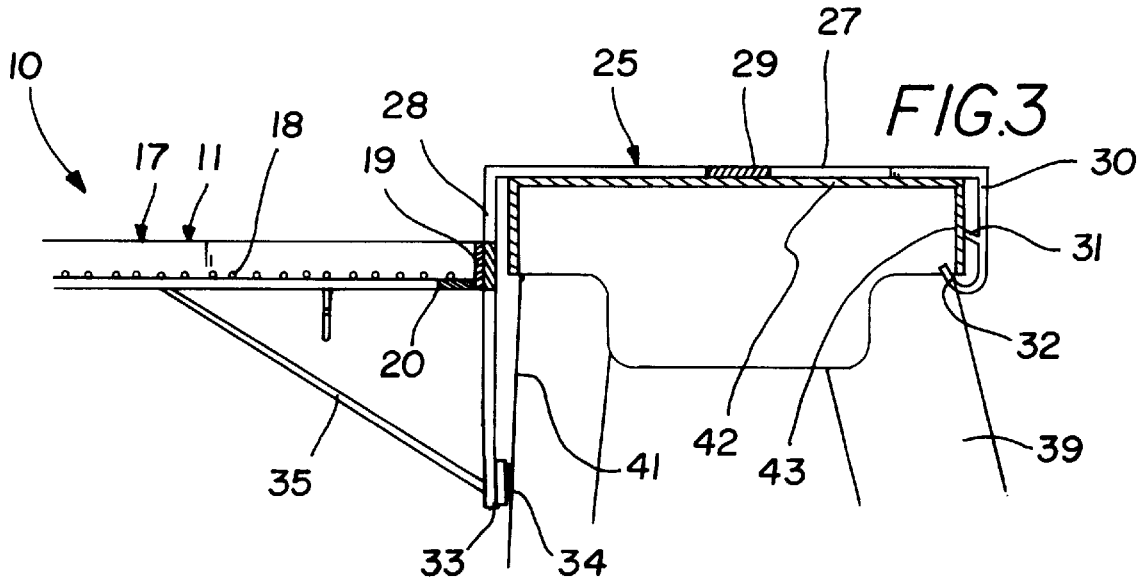
FIG. 3 is a schematic cross sectional view of the present invention in use taken from line 3—3 of FIG. 2.
Figure 4:
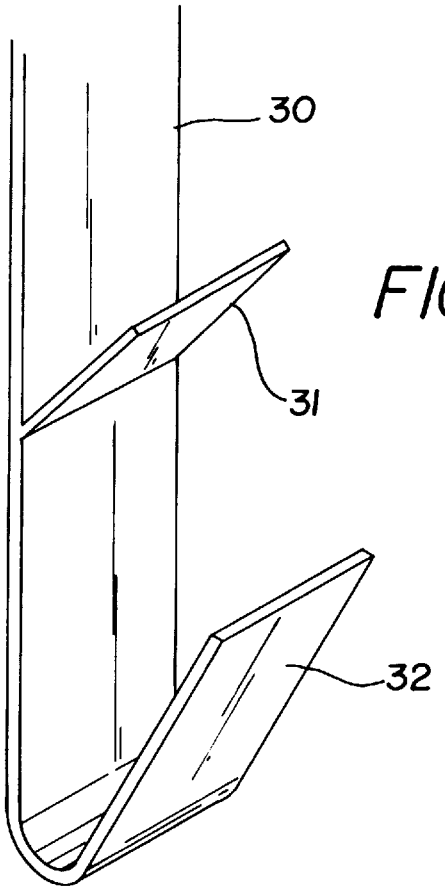
FIG. 4 is a schematic enlarged perspective view of a hooking portion of a mounting member.

As best illustrated in FIGS. 1 and 3, in use, the top portions of the mounting members are designed for resting on a head step of a stepladder. The bottom portions of the mounting members are designed for positioning adjacent a front side of the head step of the stepladder adjacent support legs of the stepladder such that the tray outwardly extends from the head step of the stepladder. The hooking portions of the mounting members are designed for positioning adjacent a back side of the head step of the stepladder adjacent side rails of the stepladder. As best shown in FIG. 3, the lower hooks of the hooking portions of the mounting members are designed for hooking beneath a perimeter lower lip of the head step of the stepladder to hold the mounting frame in place on the head step. The upper hooks of the hooking portions of the mounting member are designed for hooking beneath head steps having a smaller, less downwardly extending perimeter lip than can be hooked with the lower hooks. The back brace is designed for abutting the support legs of the stepladder such that the resiliently deformable strip faces the support legs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tray attachment for mounting to a head step of a stepladder, comprising:

a tray;

a mounting frame for mounting said tray to a head step of a stepladder, comprising:

a spaced apart pair of generally inverted L-shaped mounting members, each having elongate top and bottom portions;

said bottom portions of said mounting members being coupled to said tray such that said top portions of said mounting members outwardly extend from said tray;

said mounting members each having an elongate hooking portion downwardly depending from said top portion of the respective mounting member; and said hooking portions of said mounting members each having spaced apart upper spacing tab and lower hook outwardly extending therefrom in a direction towards said bottom portions of the respective mounting member, wherein said upper spacing tab is for maintaining proper spaced relationship between said hooking portion and the head step of the ladder;

an elongate back brace extended between said bottom portions of said mounting members, said back brace extending laterally outward beyond each of said mounting members for abutting against the support legs of the stepladder.

2. The tray attachment of claim 1, wherein said tray comprises a generally rectangular open outer frame extending along an outer perimeter of said tray and a mesh inner screen surrounded by said outer frame of said tray, said tray having portions extending laterally outward of said mounting members for positioning adjacent to the support legs of the stepladder.

3. The tray attachment of claim 2, wherein said outer frame of said tray has a generally L-shaped transverse cross section defining upper and lower portions of said outer frame extending substantially perpendicular to one another, said inner screen of said tray being rested on said lower portion of said outer frame.

4. The tray attachment of claim 1, wherein said tray has at least one utility hook coupled to an outer perimeter of tray.

5. The tray attachment of claim 1, wherein said back brace has a resiliently deformable strip provided thereon and facing in a direction towards said hooking portions of said mounting member for abutting against the support legs of the stepladder such that the resiliently deformable strip resists sliding of the back brace with respect to the support legs.

6. A tray attachment for mounting to a head step of a stepladder, the stepladder having a pair of side rails and a pair of support legs pivotally coupled to the head step of the stepladder, the stepladder further having a plurality of steps extending between the side rails of the stepladder, the head step of the stepladder having a downwardly depending perimeter lip therearound, the perimeter lip having a generally rectangular periphery, said tray attachment comprising:

a generally rectangular tray having generally rectangular upper and lower faces, and an outer perimeter comprising substantially parallel front and back edges, and a pair of substantially parallel side edges extending between said front and back edges of said tray;

said tray comprising a generally rectangular open outer frame extending along said outer perimeter of said tray and a mesh inner screen surrounded by said outer frame of said tray;

said outer frame of said tray having a generally L-shaped transverse cross section defining upper and lower portions of said outer frame extending substantially perpendicular to one another;

said inner screen of said tray being rested on said lower portion of said outer frame, said inner screen having a generally rectangular outer perimeter coupled to said outer frame of said tray;

said upper portion of said outer frame defining an upper lip upwardly extending around said outer perimeter of said inner screen for helping keep items on said upper face of said tray;

said tray having at least one utility hook coupled to said outer perimeter of tray, wherein said utility hook is positioned at one of said side edges of said tray such that said utility hook is adapted for hanging objects from said utility hook;

said tray further comprising a spaced apart pair of substantially parallel cross supports extending between said front and back edges of said tray;

said cross supports being extended substantially parallel to said side edges of said tray and substantially perpendicular to said front and back edges of said tray;

said cross supports of said tray being positioned beneath said inner screen of said tray and lying in a common plane with said lower portion of said outer frame of said tray;

a mounting frame for mounting said tray to a head step of a stepladder, comprising:

a spaced apart pair of generally inverted L-shaped mounting members each having elongate top and bottom portions, said top portion of each mounting member being extended substantially perpendicular to said bottom portion of the respective mounting member;

said bottom portions of said mounting members being coupled to said upper portion of said outer frame of said tray at said back edge of said tray, one of said mounting members being positioned towards one of said side edges of said tray, the other of said mounting members being positioned towards the other of said side edges of said tray;

said bottom portions of said mounting members being extended substantially perpendicular to a plane in which said tray lies;

said bottom portions of said mounting members each having an upper region upwardly extending from said plane of said tray and a lower region downwardly extending from said plane of said tray;

said top portions of said mounting members lying in a common plane with one another located above said plane of said tray;

an elongate upper cross brace being extended substantially perpendicularly between said top portions of said mounting members;

said mounting members each having an elongate hooking portion downwardly depending substantially perpendicularly from said top portion of the respective mounting member and spaced apart from and extending substantially parallel to said bottom portion of the respective mounting member;

said hooking portions of said mounting members each having spaced apart upper spacing tab and a lower hook outwardly extending therefrom in a direction towards said bottom portions of the respective mounting member, wherein said upper spacing tabs are for maintaining proper spaced relationship between said hooking portions and the head step of the ladder;

said upper hook of each hooking portion being spaced apart from said top portion of the associated mounting member and interposed between said top portion of the associated mounting member and said lower hook portion of the respective hook portion;

an elongate back brace extended between said bottom portions of said mounting members said back brace extending laterally outward beyond each of said mounting members for abutting against the support legs of the stepladder;

wherein said back brace has a resiliently deformable strip provided thereon and facing in a direction towards said hooking portions of said mounting member for abutting against the support legs of the stepladder such that the resiliently deformable strip resists sliding of the back brace with respect to the support legs;

said bottom portion of each mounting member being positioned adjacent an associated cross support of said tray, each bottom portion and the associated cross support lying in a common plane with one another;

each of said mounting members having an elongate strut extending between said lower end of said bottom portion of the respective mounting member and the associated cross support of the tray to provide additional support to said tray when supporting a load thereon;

said top portions of said mounting members being adapted for resting on a head step of a stepladder;

said bottom portions of said mounting members being adapted for positioning adjacent a front side of the head step of the stepladder adjacent support legs of the stepladder such that said tray outwardly extends from the head step of the stepladder;

said hooking portions of said mounting members being adapted for positioning adjacent a back side of the head step of the stepladder adjacent side rails of the stepladder;

said lower hooks of said hooking portions of said mounting members being adapted for hooking beneath a perimeter lower lip of the head step of the stepladder to hold said mounting frame in place on the head step;

said back brace being adapted for abutting the support legs of the stepladder such that said resiliently deformable strip faces the support legs.

7. In combination, a stepladder having an head step and a tray attachment mounted to the head step of a stepladder, the tray attachment comprising:

a tray;

a mounting frame mounting said tray to a head step of a stepladder, the mounting frame comprising:

a spaced apart pair of generally inverted L-shaped mounting members each having elongate top and bottom portions;

said bottom portions of said mounting members being coupled to said tray such that said top portions of said mounting members outwardly extend from said tray;

said mounting members each having an elongate hooking portion downwardly depending from said top portion of the respective mounting member; and said hooking portions of said mounting members each having spaced apart upper spacing tab and lower hook outwardly extending therefrom in a direction towards said bottom portions of the respective mounting member;

an elongate back brace extended between said bottom portions of said mounting members, said back brace extending laterally outward beyond each of said mounting members for abutting against said support legs of said stepladder.

8. The tray attachment of claim 7, wherein said tray comprises a generally rectangular open outer frame extending along an outer perimeter of said tray and a mesh inner screen surrounded by said outer frame of said tray, said tray having portions extending laterally outward of said mounting members for positioning adjacent to said support legs of said stepladder.

9. The tray attachment of claim 8, wherein said outer frame of said tray has a generally L-shaped transverse cross section defining upper and lower portions of said outer frame extending substantially perpendicular to one another, said inner screen of said tray being rested on said lower portion of said outer frame.

10. The tray attachment of claim 7, wherein said tray has at least one utility hook coupled to an outer perimeter of tray.

11. The tray attachment of claim 5, wherein said back brace has a resiliently deformable strip provided thereon and facing in a direction towards said hooking portions of said mounting member for abutting against said support legs of said stepladder such that the resiliently deformable strip resists sliding of the back brace with respect to said support legs.

* * * * *